US011732453B2

(12) United States Patent
Lee et al.

(10) Patent No.: US 11,732,453 B2
(45) Date of Patent: Aug. 22, 2023

(54) POWERLESS AUTOMATIC FLUSHING DEVICE FOR AUTOMATICALLY CONTROLLING TOILET PAPER DISPOSAL TIME ACCORDING TO FECES AND URINE

(71) Applicant: AIR VOOM INC., Seoul (KR)

(72) Inventors: Dong Jin Lee, Seoul (KR); Jae Tong Lee, Seoul (KR)

(73) Assignee: AIR VOOM INC., Seoul (KR)

( * ) Notice: Subject to any disclaimer, the term of this patent is extended or adjusted under 35 U.S.C. 154(b) by 144 days.

(21) Appl. No.: 17/600,584

(22) PCT Filed: Apr. 1, 2020

(86) PCT No.: PCT/KR2020/004437
§ 371 (c)(1),
(2) Date: Apr. 27, 2022

(87) PCT Pub. No.: WO2020/204589
PCT Pub. Date: Oct. 8, 2020

(65) Prior Publication Data

US 2022/0282470 A1 Sep. 8, 2022

(30) Foreign Application Priority Data

Apr. 3, 2019 (KR) ..... 10-2019-0039000

(51) Int. Cl.
*E03D 5/02* (2006.01)
*E03D 5/04* (2006.01)

(52) U.S. Cl.
CPC ..... *E03D 5/022* (2013.01); *E03D 5/04* (2013.01)

(58) Field of Classification Search
CPC ..... E03D 5/022; E03D 5/024; E03D 5/04
USPC ..... 4/313, 405, 407–409, 411–412
See application file for complete search history.

(56) References Cited

U.S. PATENT DOCUMENTS 5,369,816 A * 12/1994 Chen ..... E03D 5/04 4/405
2019/0040614 A1* 2/2019 Lee ..... E03D 5/04

FOREIGN PATENT DOCUMENTS

| | | | |
|---|---|---|---|
| KR | 10-0946393 | B1 | 3/2010 |
| KR | 10-1071981 | B1 | 10/2011 |
| KR | 10-1389941 | B1 | 4/2014 |
| KR | 10-1535278 | B1 | 7/2015 |

* cited by examiner

*Primary Examiner* — Tuan N Nguyen
(74) *Attorney, Agent, or Firm* — Goldilocks Zone IP Law

(57) ABSTRACT

A powerless automatic flushing device is proposed. The device controls flushing of feces and time to dispose of toilet paper with feces while suctioning air from outside through a feces toilet paper time adjustment part and a flushing adjustment part when a toilet user defecates and leaves a toilet seat, and respectively controls the flushing of urine and time to dispose of toilet paper with urine while rapidly suctioning the air from the outside through each of a feces toilet paper time adjustment part, a flushing adjustment part, and a urine toilet paper time adjustment part when the toilet user urinates and leaves the toilet seat, thereby preventing the toilet user from wasting the water by unnecessarily pressing a lever, and a tension load spring compresses in conjunction with descending motion of the toilet seat and retains a tension load force capable of pulling a flushing wire.

12 Claims, 12 Drawing Sheets

POWERLESS AUTOMATIC FLUSHING DEVICE FOR AUTOMATICALLY CONTROLLING TOILET PAPER DISPOSAL TIME ACCORDING TO FECES AND URINE

CROSS-REFERENCE TO RELATED APPLICATIONS

This application claims the benefit under 35 U.S.C. section 371, of PCT International Application No. PCT/KR2020/004437, filed on Apr. 1, 2020, which claims foreign priority to Korean Patent Application No. 10-2019-0039000, filed on Apr. 3, 2019, in the Korean Intellectual Property Office, both of which are hereby incorporated by reference in their entireties.

TECHNICAL FIELD

The present disclosure relates to a powerless automatic flushing device and, more particularly, to a powerless automatic flushing device, wherein the device controls flushing of feces and time to dispose of toilet paper with feces while suctioning air from outside through a feces toilet paper time adjustment part and a flushing adjustment part when a toilet user defecates and leaves a toilet seat, and respectively controls flushing of urine and time to dispose of toilet paper with urine while rapidly suctioning the air from the outside through each of a feces toilet paper time adjustment part, a flushing adjustment part, and a urine toilet paper time adjustment part when the toilet user urinates and leaves the toilet seat, thereby preventing the toilet user from wasting water by unnecessarily pressing a lever, and a tension load spring compresses in conjunction with descending motion of the toilet seat and retains a tension load force capable of pulling a flushing wire, and the wire guide is rotated by the tension load spring, which is restored in conjunction with ascending motion of the toilet seat and opens a water drain hole while pulling the flushing wire, whereby operation works smoothly and stable and the time to dispose of the toilet paper is automatically controlled to improve flushing power for excreta according to defecation or urination.

BACKGROUND ART

In general, a toilet bowl is installed in a bathroom in a home or building, and is configured such that after excretion of a toilet user, the flushing water that is drained by a lever moved by the toilet user and the excreta of the toilet user are discharged into a septic tank. A powerless automatic flushing device in which the flushing of water is automatically operated by applying water pressure has been registered as Korean Patent No. 10-0946393.

The previously registered patent has a configuration for flushing excreta of defecation or urination with the flushing water, wherein when a toilet seat is sat in by a toilet user, the water from a faucet is supplied to an operation part through a water channel that is opened by the weight load of the toilet user and a cylinder rod moves while compressing a spring with pressure of water supplied to the operation part, and simultaneously the water that has moved the cylinder rod by restoring force of the compressed spring is supplied to a flushing device, whereby the feces and/or urine are flushed by the flushing water discharged from the flushing device.

However, in the previously registered patent, when water pressure of the water supplied from the faucet is weaker than the spring tension, the water pressure is unable to press and move the cylinder rod, so the function of the automatic flushing device is lost due to the fact that flushing does not work and the defecation and urination of the toilet user are not determined, thereby causing a problem of lowering toilet user's reliability in the product.

In addition, in a case where excreta is flushed in a public toilet having multiple toilet bowls at the same time, as water pressure decreases while water is supplied to the toilet bowls, the amount of water that is for flushing urine is discharged for flushing feces because the cylinder rod does not advance as much as a position for determining defecation, thereby causing problems such that unflushed feces cause clogging of the toilet bowls or generating of odors, inconvenience occurs such that the water has to be flushed once more by manually pressing the lever in order to flush the remnants of the feces, and it is not only uneconomical due to wasting of the water but also unsanitary.

In addition, there are problems that since the configuration of the operation part operated by hydraulic pressure is complicated, productivity is reduced and manufacturing cost is increased, thereby decreasing economic feasibility, and also there are problems that many components of the configuration causes not only a malfunction due to accumulation of foreign substances in a water passage but also a water leakage through the connection areas.

In order to solve the above problems, recently, Korean Patent No. 10-1071981 has been registered, wherein a toilet seat is able to automatically flush a toilet after distinguishing defecation and urination by using only energy of weight load of the human body.

In the previously registered patent, as a gap between a first and second tension load rollers is narrowed while a toilet seat descends by the weight load of a toilet user seated on the toilet seat, when a tension load force of a tension load wire is lost and at the same time a detachable member fixed to a tension load wire fixing member presses a feces and urine distinction determination part while moving because the toilet seat descends, it is determined as urination, and also when the cylinder rod presses the feces and urine distinction determination part, it is determined as defecation. In such a state, as the gap between the first and second tension load rollers is widened by the restoring force of the toilet seat as the toilet user leaves the toilet seat, the tension load wire is tense and simultaneously the flushing wire is pulled, so the flushing water corresponding to the defecation and urination is discharged to a toilet body to flush the feces and urine, and thus the conventional problems may be solved.

However, in the previously registered patent, in a case where fluid is supplied to a cylinder by the weight load of the toilet user who sits and leaves the toilet seat, since a fluid movement structure is complicated and the number of components increases, there are problems that not only the assembly is difficult but also the economic feasibility is decreased due to the increase in the manufacturing cost.

In addition, there are problems that the maintenance is difficult and a defect rate is high due to the risk of fluid leaking through the connection areas of the components, the operation time varies depending on a viscosity difference depending on the amount of oil injection and the temperature change, and on/off errors of a water passage opening/closing valve mounted separately causes no flushing or continuous flushing, whereby the toilet user loses reliability in the product.

In order to solve the above problems, a powerless automatic flushing toilet seat for a flush valve that is provided with a control function of discharging and intaking air only with weight load of the human body has been registered in Korean Patent No. 10-1389941.

In the previously registered patent, when a toilet user is seated on a toilet seat, a tension load member retains a tension load force for pulling a flushing wire in conjunction with descending motion of the toilet seat, and when the toilet user leaves the toilet seat, not only the flushing wire that is pulled in conjunction with ascending motion of the toilet seat rotates a siphon cover upward while the flushing water from a tank is discharged into a toilet bowl through an opened water drain hole to flush the excreta, but also the operation time of flushing is controlled by adjusting the amount of air suctioned into a toilet paper time adjustment part, and thus the conventional problems may be solved.

However, in the previously registered patent, the tension load force capable of pulling the flushing wire may be retained in the tension load member by the descending motion of the toilet seat, but according to the rotational movement of the lever, friction and load of the tension load wire that pulls the tension load member occur, so power conveyance efficiency is decreased, and the siphon cover may not be sufficiently lifted. Accordingly, since the flushing water stored in the tank is not discharged smoothly, the flushing power for excreta is decreased and the unflushed feces or foreign substances remain in the toilet bowl, so as to result in clogging the toilet bowl or generating the odors, thereby causing the problem of lowering the toilet user's reliability in the product.

In addition, the siphon cover should be operated in a way of being sufficiently lifted so that the flushing water may be discharged smoothly, but due to the height of the toilet seat, there are problems of causing inconvenience to the toilet user and being subject to design limitation of the toilet seat. Further, there are problems that as the number of components increases, the assembly becomes difficult, so not only the working time increased, but also the economic feasibility is decreased due to the increase of the manufacturing cost.

In order to solve the above problems, recently, Korean Patent No. 10-1535278 has been registered, wherein a powerless automatic flushing device is provided with a tension load and pressurizing protrusion that maximizes a flushing function for a toilet bowl by the lowest weight load of the human body and the minimal operation for a seating switch.

In the previously registered patent, the air inside a guide rib is discharged to outside in conjunction with descending motion of a toilet seat by the weight load of a toilet user, and at the same time, while a tension load member rotates by the pressing of a pressurization protrusion, a tension load force capable of pulling a flushing wire is allowed to be retained. In addition, when the weight load of the toilet user is released, the amount of air introduced into the guide rib is adjusted to control the time to dispose of toilet paper of the toilet user, and also as the flushing wire is pulled by the restoring force of the tension load member, the flushing water from a tank is discharged to a toilet body through a water drain hole opened by the ascending of a siphon cover, so as to flush the excreta, whereby the conventional problems may be solved.

However, the previously registered patent has a configuration in which the force capable of pulling the flushing wire is loaded while the tension load member is rotated by the pressurization of the pressurization protrusion, so there is a problem that when the tension load member rotates by the vertical movement of the pressurization protrusion, not only the operation is not smooth due to the frictional force between the pressurization protrusion and the tension load member, but also it is difficult to maintain the configuration due to damage to components. In addition, there is a problem that in order to rotate the tension load member, the toilet user's weight load that moves the pressurization protrusion should be heavy enough for smooth operation.

In addition, when a flushing opening/closing part is operated by the tension load force of the tension load member, the operation of the flushing opening/closing part should be released while the tension load member moves along a lock release member, but since the tension load member moves in close contact with the inclined lock release member, there is a problem that not only the operation is not smooth due to the frictional force between the tension load member and the lock release member, but also it is difficult to maintain due to damage to the components.

In addition, since the configuration of each of the parts that realizes the flushing of water is composed of individual components and assembled on a toilet seat, there are problems that the work process is complicated, and the working time for assembly is increased, thereby leading to a decrease in economic efficiency due to the increase in labor costs.

In addition, after assembling each component on a lower plate of the toilet seat, each component should be waterproofed in a process of covering an upper plate of the toilet seat, but there are problems that a waterproof condition is difficult to manage due to the fact that an area where each component is installed is large, taking action is difficult when an after-sales service is required, and excreta and foreign substances are introduced into a seat switch, causing odors and malfunctioning errors during use of the toilet seat.

DISCLOSURE

Technical Problem

The embodiment of the present disclosure has been devised in consideration of the various conventional problems as described above, and an objective of the present disclosure is to provide a powerless automatic flushing device that automatically controls time to dispose of toilet paper according to feces and urine, wherein the device controls flushing of feces and the time to dispose of toilet paper with feces while suctioning air from outside through a feces toilet paper time adjustment part and a flushing adjustment part when a toilet user defecates and leaves a toilet seat, and respectively controls flushing of urine and time to dispose of toilet paper with urine while rapidly suctioning the air from the outside through each of a feces toilet paper time adjustment part, a flushing adjustment part, and a urine toilet paper time adjustment part when the toilet user urinates and leaves the toilet seat, thereby preventing the toilet user from wasting water by unnecessarily pressing a lever.

In addition, another objective of the present disclosure is to provide a powerless automatic flushing device that automatically controls the time to dispose of toilet paper according to feces and urine, wherein a tension load spring compresses in conjunction with descending motion of the toilet seat and retains a tension load force capable of pulling a flushing wire, and the wire guide is rotated by the tension load spring, which is restored in conjunction with ascending motion of the toilet seat, and opens a water drain hole while pulling the flushing wire, whereby operation works smoothly and stable and the time to dispose of the toilet paper is automatically controlled to improve flushing power for excreta according to feces and urine.

Technical Solution

According to the present disclosure, a powerless automatic flushing device for automatically controlling toilet paper disposal time is configured to include:

a detection switch configured to guide descending motion of a toilet seat under a weight load of a toilet user, and allow the toilet seat to ascend when the pressurizing weight load is released as the toilet user leaves the toilet seat;

a feces and urine toilet paper time control and flushing adjustment part configured to discharge air inside a guide rib while a flushing adjustment part ascends in conjunction with the descending motion of the toilet seat, control time to dispose of toilet paper with the feces while suctioning air from outside through a feces toilet paper time adjustment hole with a restoring force of a restoration spring when the toilet user leaves the toilet seat after defecation, and control time to dispose of toilet paper with the urine while rapidly suctioning the air from the outside through the feces toilet paper time adjustment hole and a urine toilet paper time adjustment hole when the toilet user leaves the toilet seat after urination;

a feces and urine toilet paper time determination part configured to adjust an amount of air discharged from inside a distinction guide rib to the outside while a guide rod moves to an inside of the distinction guide rib in conjunction with the descending motion of the toilet seat, determine excretion as the urination when a feces and urine toilet paper time determination member fails to press a urine toilet paper time distinction pin, and a urine toilet paper time adjustment hole is opened, and determine the excretion as the defecation when the feces and urine toilet paper time determination member presses the urine toilet paper time distinction pin and closes the urine toilet paper time adjustment hole;

a tension load part configured to retain a tension load force capable of pulling a flushing wire of a flushing opening/closing part while a tension load spring is compressed by rotation of a tension load lever in conjunction with the descending motion of the toilet seat, and rotate a wire guide with the restoring force of the tension load spring to pull the flushing wire as the toilet seat ascends when the pressurizing weight load of the toilet user is released; and the flushing opening/closing part configured to open a water drain hole while a siphon cover rotates by the flushing wire, which is rotated and pulled by the wire guide by the tension load force of the tension load spring, flush excreta with flushing water supplied to a toilet body through the water drain hole, and close the water drain hole while restoring the wire guide by descending of the siphon cover when the tension load force of the tension load spring is released.

In addition, according to the present disclosure, a powerless automatic flushing device for automatically controlling toilet paper disposal time according to feces and urine is configured to include:

a detection switch configured to guide descending motion of a toilet seat under a weight load of a toilet user, and allow the toilet seat to ascend when the pressurizing weight load is released as the toilet user leaves the toilet seat;

a feces and urine toilet paper time control and flushing adjustment part configured to discharge air inside a guide rib while a flushing adjustment part and a urine toilet paper time adjustment part ascend in conjunction with the descending motion of the toilet seat, control time to dispose of toilet paper with the feces and time to flush the feces while suctioning air from outside through a feces toilet paper time adjustment hole and the feces flushing adjustment hole with a restoring force of a restoration spring when the toilet user leaves the toilet seat after defecation, and control the flushing of urine and time to dispose of toilet paper with the urine while rapidly suctioning the air from the outside through the feces toilet paper time adjustment hole, the feces flushing adjustment hole, and a urine toilet paper time adjustment hole when the toilet user leaves the toilet seat after urination;

a feces and urine toilet paper time determination part configured to adjust an amount of air discharged from inside a distinction guide rib to the outside while a guide rod moves to an inside of the distinction guide rib in conjunction with the descending motion of the toilet seat, determine excretion as the urination when a feces and urine toilet paper time determination member fails to press a urine toilet paper time distinction pin, and a urine toilet paper time adjustment hole is opened, and determine the excretion as the defecation when the feces and urine toilet paper time determination member presses the urine toilet paper time distinction pin and closes the urine toilet paper time adjustment hole;

a tension load part configured to retain a tension load force capable of pulling a flushing wire of a flushing opening/closing part while a tension load spring is compressed by rotation of a tension load lever in conjunction with the descending motion of the toilet seat, and rotate a wire guide with the restoring force of the tension load spring to pull the flushing wire as the toilet seat ascends when the pressurizing weight load of the toilet user is released; and the flushing opening/closing part configured to open a water drain hole while a siphon cover rotates by the flushing wire, which is rotated and pulled by the wire guide by the tension load force of the tension load spring, flush excreta with flushing water supplied to a toilet body through the water drain hole, and close the water drain hole while restoring the wire guide by descending of the siphon cover when the tension load force of the tension load spring is released.

Advantageous Effects

According to the present disclosure, there is provided an advantage that the powerless automatic flushing device controls flushing of feces and the time to dispose of toilet paper with feces while suctioning air from outside through a feces toilet paper time adjustment part and a flushing adjustment part when a toilet user defecates and leaves a toilet seat, and respectively controls the flushing of urine and the time to dispose of toilet paper with urine while rapidly suctioning the air from the outside through each of a feces toilet paper time adjustment part, a flushing adjustment part, and a urine toilet paper time adjustment part when the toilet user urinates and leaves the toilet seat, so as to prevent unnecessary wasting of water, thereby improving the reliability of the product.

In addition, according to the present disclosure, there is provided an advantage that the tension load spring compresses in conjunction with descending motion of the toilet seat and retains a tension load force capable of pulling a flushing wire, and a wire guide is rotated by a tension load spring, which is restored in conjunction with ascending motion of the toilet seat, and opens a water drain hole while pulling the flushing wire, whereby the operation works smoothly and stable and the flushing power for excreta is improved.

MODE FOR INVENTION

Figure 1:
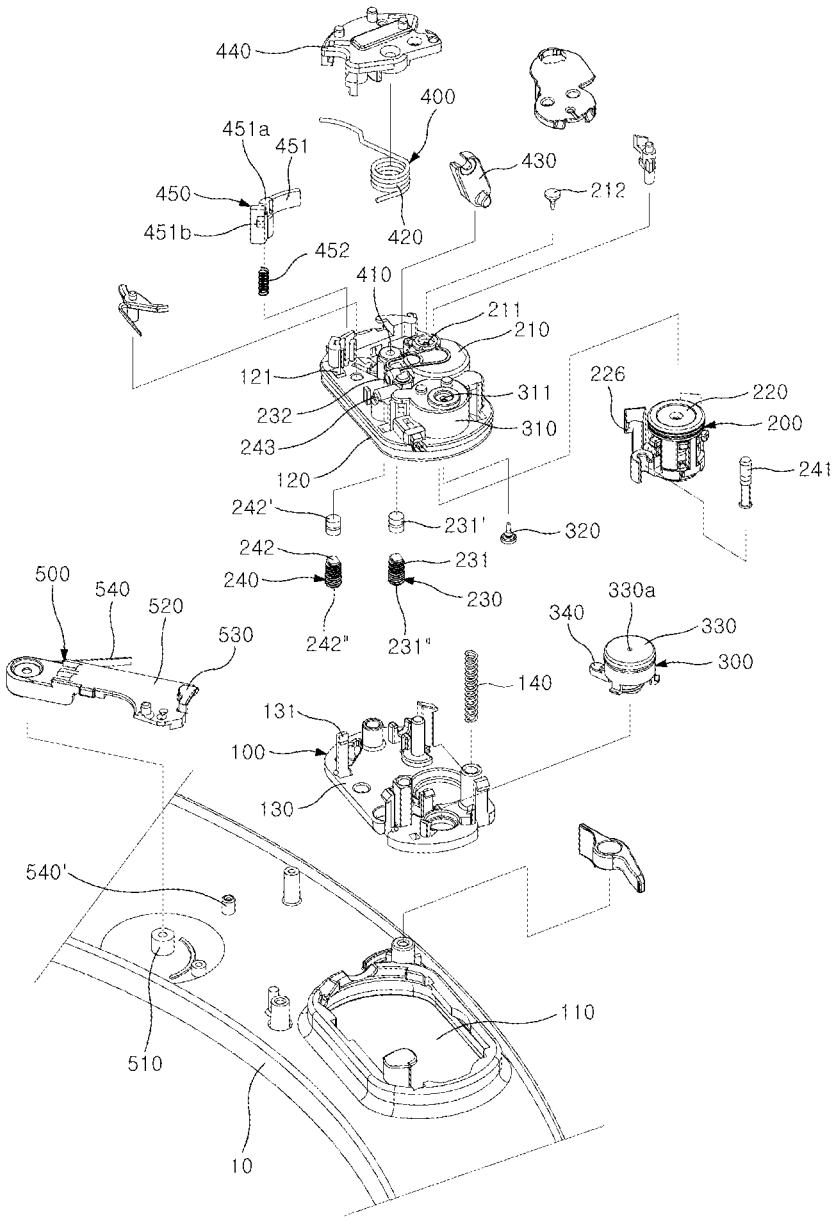
FIG. 1 is an exploded perspective view of the present disclosure.
Figure 2:
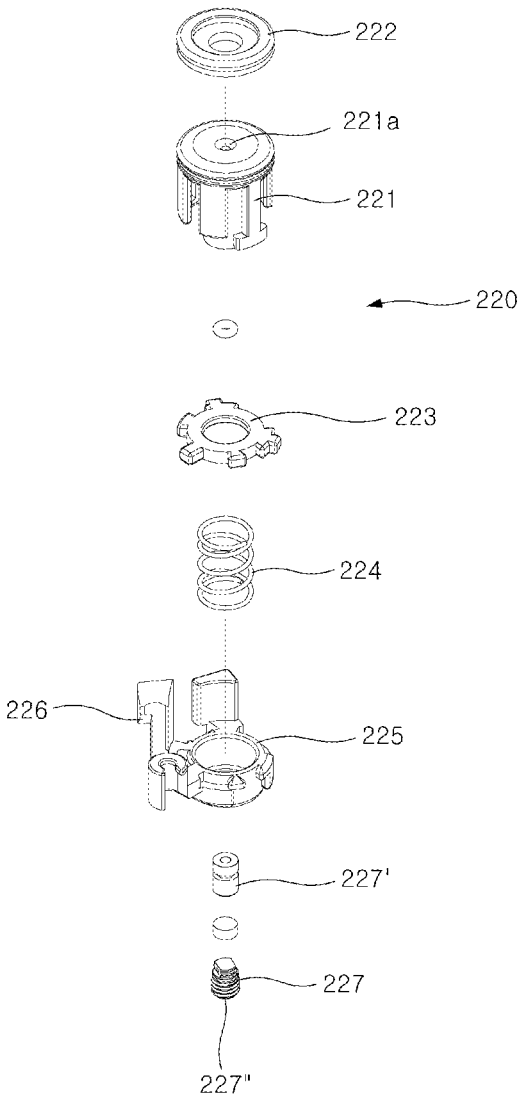
FIG. 2 is an exploded perspective view illustrating a flushing adjustment part of the present disclosure.
Figure 3:
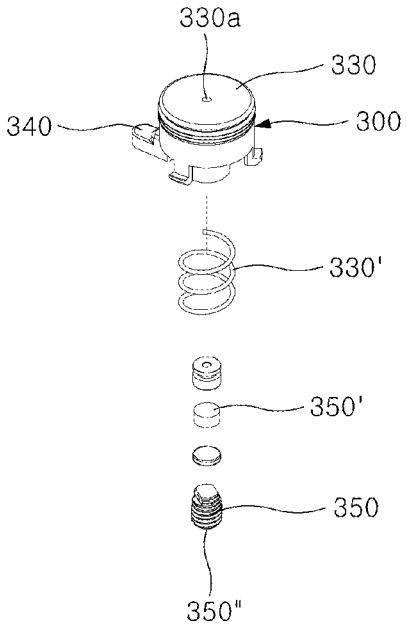
FIG. 3 is an exploded perspective view illustrating a feces and urine toilet paper time determination part according to the present disclosure.
Figure 4:
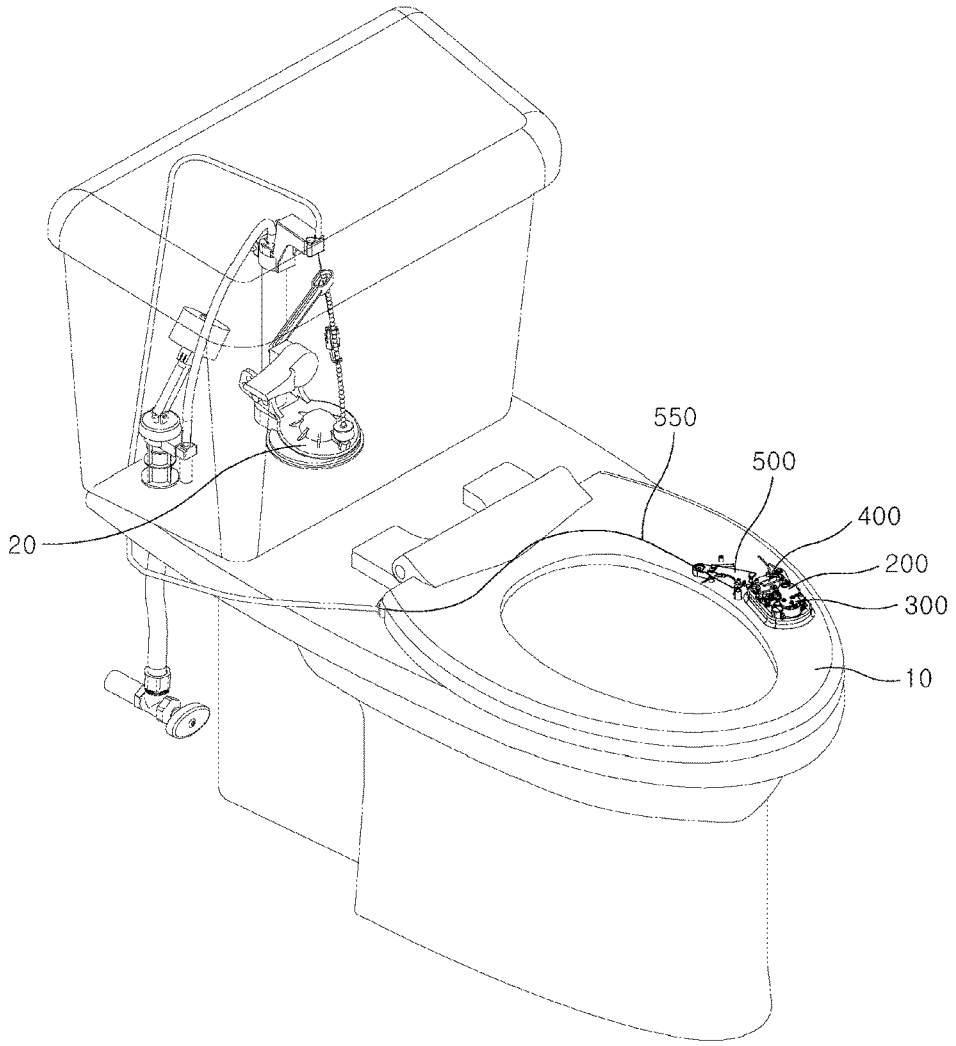
FIG. 4 is a view illustrating an installation state of the present disclosure.

Hereinafter, the present disclosure will be described in detail on the basis of the accompanying drawings. FIG. 1 is an exploded perspective view of the present disclosure, FIG. 2 is an exploded perspective view illustrating a flushing adjustment part of the present disclosure, and FIG. 3 is an exploded perspective view illustrating a feces and urine toilet paper time determination part according to the present disclosure.

A powerless automatic flushing device that automatically controls time to dispose of toilet paper according to feces and urine according to the present disclosure includes: a detection switch 100 configured to guide descending motion of a toilet seat 10 under a weight load of a toilet user, and allow the toilet seat 10 to ascend when the pressurizing weight load is released as the toilet user leaves the toilet seat 10; a feces and urine toilet paper time control and flushing adjustment part 200 configured to discharge air inside a guide rib 210 while a flushing adjustment part 220 and a urine toilet paper time adjustment part 240 ascend in conjunction with the descending motion of the toilet seat 10, control time to dispose of toilet paper with feces and time to flush the feces while suctioning air from outside through a feces toilet paper time adjustment hole 231" and the feces flushing adjustment hole 227" with a restoring force of a restoration spring 224 when the toilet user leaves the toilet seat after defecation, and control the flushing of urine and time to dispose of toilet paper with urine while rapidly suctioning the air from the outside through the feces toilet paper time adjustment hole 231", the feces flushing adjustment hole 227", and a urine toilet paper time adjustment hole 242" when the toilet user leaves the toilet seat after urination; a feces and urine toilet paper time determination part 300 configured to adjust an amount of air discharged from inside a distinction guide rib 310 to the outside while a guide rod 330 moves to an inside of the distinction guide rib 310 in conjunction with the descending motion of the toilet seat 10, determine excretion as urination when the feces and urine toilet paper time determination member 340 fails to press the urine toilet paper time distinction pin 241, and the urine toilet paper time adjustment hole 243 is opened, and determine the excretion as defecation when the feces and urine toilet paper time determination member 340 presses the urine toilet paper time distinction pin 241 and closes the urine toilet paper time adjustment hole 243; a tension load part 400 configured to retain a tension load force capable of pulling a flushing wire 550 of the flushing opening/closing part 500 while a tension load spring 420 is compressed by rotation of a tension load lever 430 in conjunction with the descending motion of the toilet seat 10, and rotate a wire guide 520 with the restoring force of the tension load spring 430 to pull the flushing wire 550 as the toilet seat 10 ascends when the pressurizing weight load of the toilet user is released; and a flushing opening/closing part 500 configured to open a water drain hole while a siphon cover 20 rotates by the flushing wire 550, which is rotated and pulled by the wire guide 520 by the tension load force of the tension load spring 430, flush excreta with flushing water supplied to a toilet body through the water drain hole, and close the water drain hole while restoring the wire guide 520 by descending of the siphon cover 20 when the tension load force of the tension load spring 430 is released.

The detection switch 100 includes: an installation hole 110 formed on a toilet seat; a cover 120 configured to be mounted on the installation hole 110 and have a hook coupling hole 121 penetrating therein, to which a hook 131 protruding from a detection plate 130 is allowed to be coupled; the detection plate 130 mounted to a toilet body as the hook 131 is coupled to the hook coupling hole 121 penetrating the cover 120; and a seat spring 140 mounted between the cover 120 and the detection plate 130.

The feces and urine toilet paper time control and flushing adjustment part 200 includes: a guide rib 210 configured to protrude from the cover 120 of the detection switch 100, have a discharge through-hole 211 penetrating therein to be opened and closed by an inflow check valve 212, and have a feces toilet paper time and flushing distinction protrusion 213 protruding from an inner bottom surface thereof; a flushing adjustment part 220 configured to be embedded in the guide rib 210, discharge air inside the guide rib 210 to the inflow check valve 212 opened in conjunction with the descending motion of the toilet seat, and adjust an amount of air introduced into the guide rib 210 while closing the inflow check valve 212 in conjunction with the ascending motion of the toilet seat; a feces toilet paper time adjustment part 230 configured to be mounted in the guide rib 210 on one side of the flushing adjustment part 220 and adjust the amount of the air introduced into the guide rib 210; a urine toilet paper time adjustment part 240 configured to ascend and descend by the feces and urine toilet paper time determination member 340 of the feces and urine toilet paper time determination part 300 to open and close the urine toilet paper time adjustment hole 243 when the toilet user leaves the toilet seat, and adjust the amount of the air introduced into the guide rib 210; and a tension load release guide member 260 configured to be pressed by the pressurization release piece 226 while the flushing adjustment part 220 ascends into the guide rib 210, and release a supporting force of a tension load retention member 450 of the tension load part 400.

The flushing adjustment part 220 includes: an air inflow adjustment member 221 configured to ascend and descend inside of the guide rib 210 and have a through-hole **221*a* penetrating therein, to which the feces toilet paper time and flushing determination protrusion 213 is allowed to be coupled; a seating cover 222 seated on an upper surface of the air inflow adjustment member 221; a flush washer 223 mounted on the air inflow adjustment member 221 to support a restoration spring 224; a restoration spring 224 mounted on the air inflow adjustment member 221 so as to be in close contact with the flush washer 223; a separation prevention member 225 configured to be mounted on a lower end of the air inflow adjustment member 221 to compress the restoration spring 224 in conjunction with the descending motion of the toilet seat 10 while preventing the restoration spring 224 from being separated and have a distinction pin control groove 225***a* formed on an outer peripheral surface thereof; a pressurization release piece 226 formed on one side of the separation prevention member 225; and a feces flushing adjustment bolt 227 configured to have an adjustment filter 227' mounted on a lower inner side of the air inflow adjustment member 221 to adjust the amount of air introduced into the through-hole 221*a*, and have an inside thereof through which a feces flushing adjustment hole 227" communicates.

The feces toilet paper time adjustment part 230 includes: a feces toilet paper time adjustment bolt 231 configured to be mounted on the lower part of the guide rib 210, have an adjustment filter 231' mounted thereon to adjust the amount of the air introduced into the guide rib 210, and have an inside thereof through which a feces toilet paper time adjustment hole 231" communicates; and a feces toilet paper time adjustment hole 232 configured to communicate the feces toilet paper time adjustment bolt 231 and the inside of the guide rib 210.

The urine toilet paper time adjustment part 240 includes: a urine toilet paper time distinction pin 241 configured to be mounted on the distinction pin control groove 225*a* of the flushing adjustment part 220 and determine the excretion as urination when a urine toilet paper time adjustment hole 243 is not closed; a urine toilet paper time adjustment bolt 242 configured to be mounted on a lower part of the guide rib 210 on one side of the feces toilet paper time adjustment part 230, have an adjustment filter 242' mounted thereon so as to adjust the amount of the air introduced into the guide rib 210, and have an inside thereof, through which a urine toilet paper time adjustment hole 242" communicates; and the urine toilet paper time adjustment hole 243 configured to communicate the urine toilet paper time adjustment bolt 242 and the inside of the guide rib 210.

The tension load release guide member 260 includes: a tension load release guide body 261 configured to be mounted on a body coupling hole formed in the cover 120 and rotate; a tension load release control protrusion 262 formed on one side of the tension load release guide body 261 so as to be selectively caught on the tension load retention control protrusion 451*b* of the tension load retention member 450; a tension load release guide protrusion 263 formed on the other side of the tension load release guide body 261 at an obtuse angle with the tension load release control protrusion 262 so as to allow the pressurization release piece 226 to press; and a restoration elastic piece 264 configured to protrude with elasticity from one side of the tension load release guide body 261 and be supported by an elastic support piece 264' formed on the cover 120 so as to restore the tension load release guide body 261 in which the pressurizing force of the pressurization release piece 226 is released.

The feces and urine toilet paper time determination part 300 includes: a distinction guide rib 310 configured to protrude from the cover 120 of the detection switch 100 and have an inside thereof, through which an inflow through-hole 311 penetrates; a feces and urine distinction discharge check valve 320 configured to open and close the inflow through-hole 311 of the distinction guide rib 310; a guide rod 330 configured to be embedded in the distinction guide rib 310 and discharge the air inside the distinction guide rib 310 to a guide through-hole 330*a* while moving by the pressure of a guide spring 330' in conjunction with the descending motion of the toilet seat 10; a feces and urine toilet paper time determination member 340 configured to protrude from one side of a guide rod 330 and press the urine toilet paper time distinction pin 241; and a feces and urine distinction discharge amount adjustment bolt 350 configured to be fastened to a lower inner side of the guide rod 330, have an adjustment filter 350' mounted thereon to adjust an amount of air discharged to the guide through-hole 330*a*, and have a feces and urine distinction discharge amount adjustment hole 350" formed therein and communicating inside of the distinction guide rib 310.

The tension load part 400 includes: a tension load shaft 410 configured to protrude from the cover 120 of the detection switch 100; a tension load member 420 configured to be mounted on the tension load shaft 410, be caught on a guide protrusion 530 while rotated by the pressure of a tension load lever 430, and secure the tension load force capable of pulling the flushing wire 550; a tension load lever 430 configured to be rotatably mounted in a guide groove 430*a* formed in the detection plate 130 of the detection switch 100 and accommodate one end of the tension load spring 420 so as to press and rotate the tension load spring 420; a lever guide 440 configured to be mounted on the cover 120 to prevent separation of the tension load lever 430 from the guide groove 430*a*; and a tension load retention member 450 configured to hold the tension load force until the tension load spring 420 is released while accommodating the tension load spring 420 in which the tension load force is generated by rotation under the pressure of the tension load lever 430.

The tension load retention member 450 includes: a tension load retention body 451 configured to have a locking protrusion 451*a* formed inclined so that the tension load spring 420 moves and is caught, and have a tension load retention control protrusion 451*b* formed on the other side of the locking protrusion 451*a*; and a control spring 452 configured to support the tension load retention body 451.

The flushing opening/closing part 500 includes: a rotation guide shaft 510 formed on the toilet seat 10; a wire guide 520 rotatably mounted to the rotation guide shaft 510; the guide protrusion 530 configured to obliquely protrude from one end of the wire guide 520 to be rotatable by the tension load spring 420; an elastic piece 540 configured to protrude from a side end of the wire guide 520 to support the wire guide 520; and the flushing wire 550 configured to connect the wire guide 520 and a siphon cover 20 to each other and flush the water by rotation of the wire guide 520.

The following describes the operation process of the present disclosure configured as described above.

Figure 5:
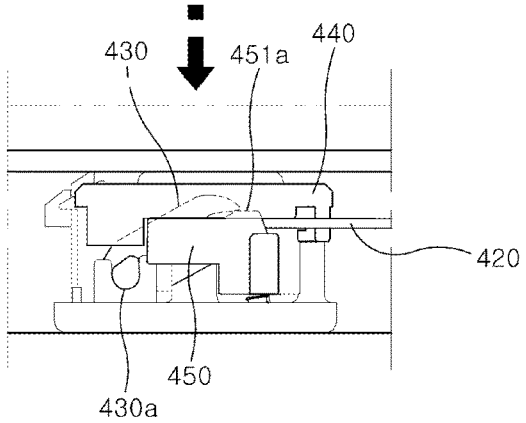
FIGS. 5 to 11 are views illustrating operating states when a toilet user is seated on a toilet seat to which the present disclosure is applied.
Figure 6:
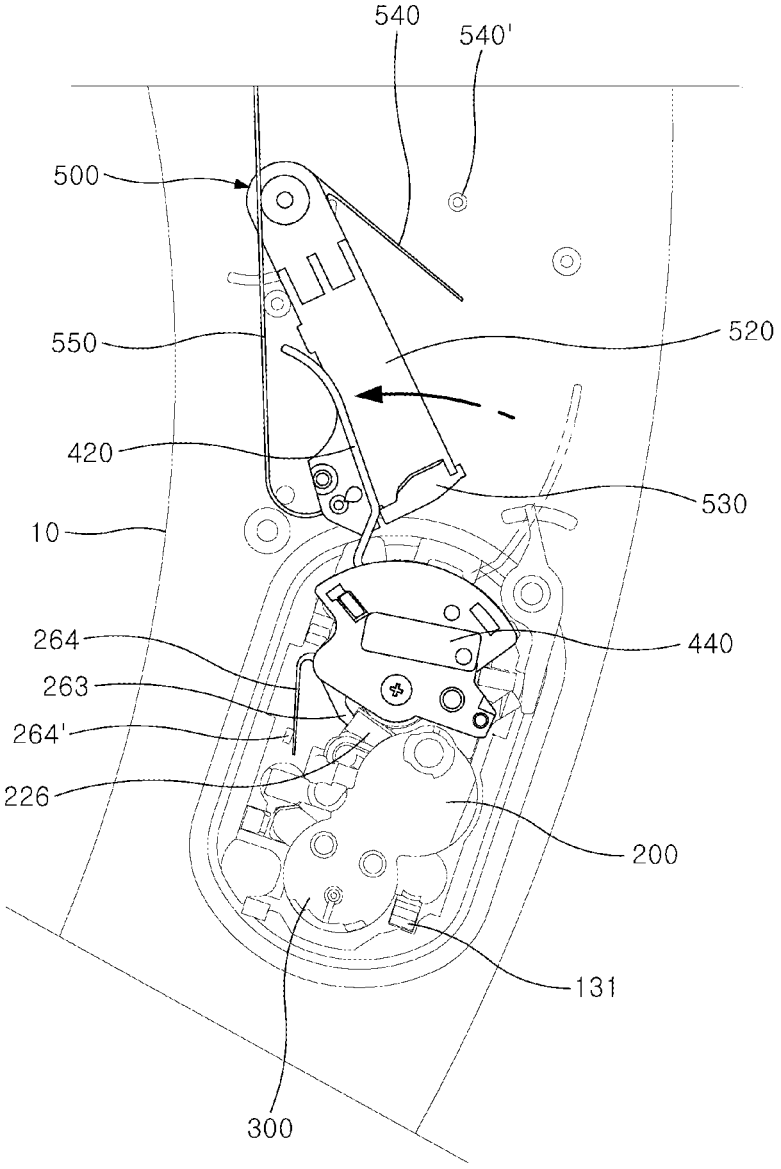
Figure 7:
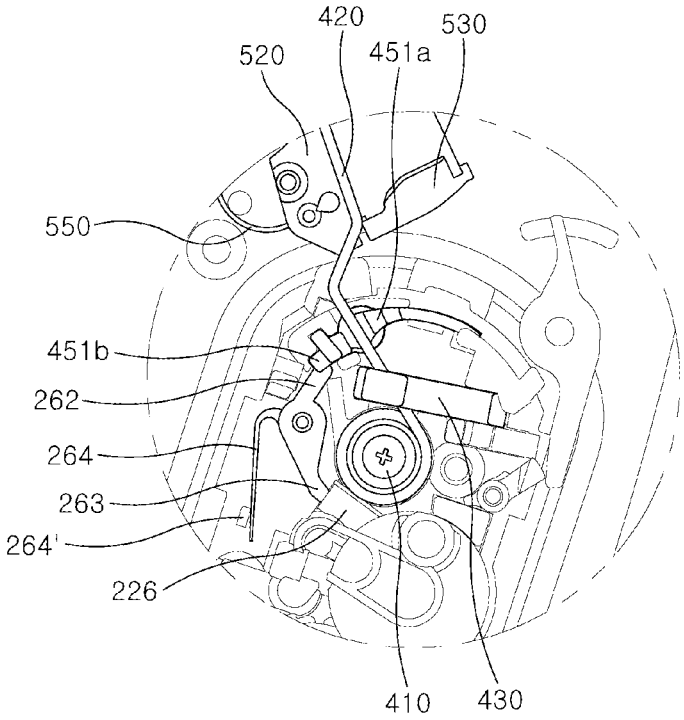
Figure 8:
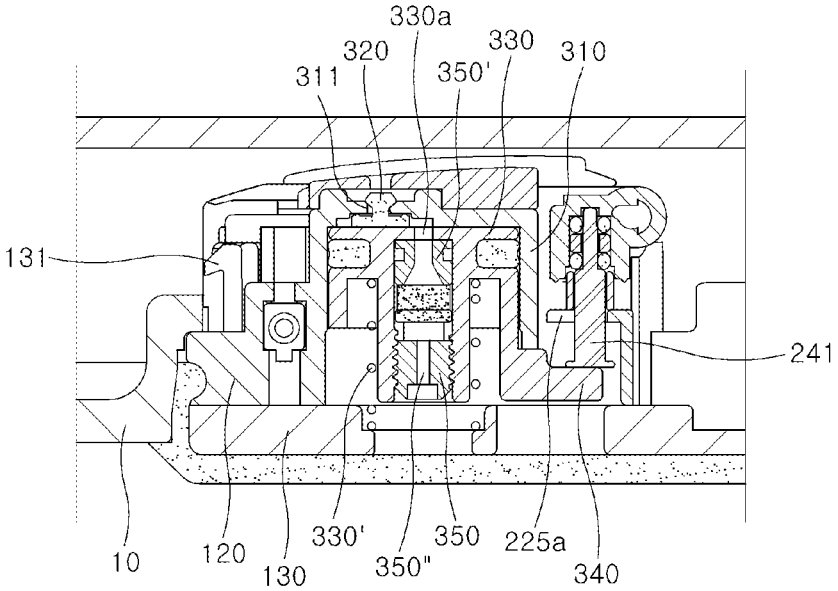
Figure 9:
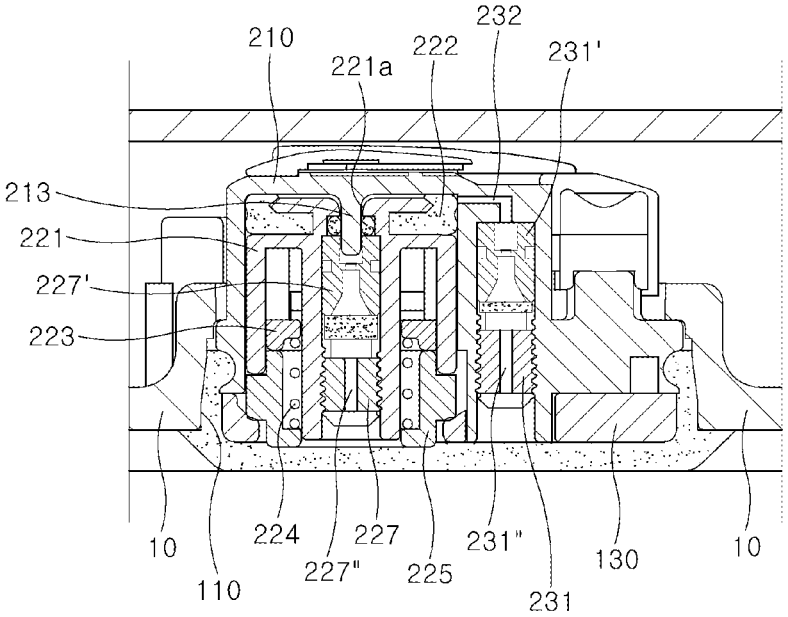
Figure 10:
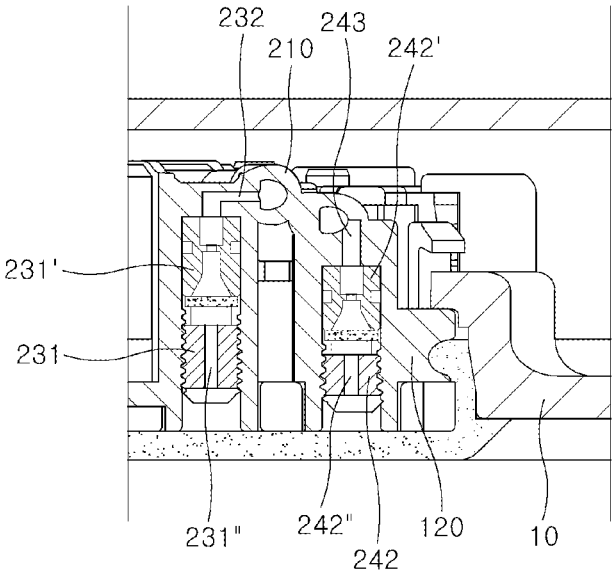
Figure 11:
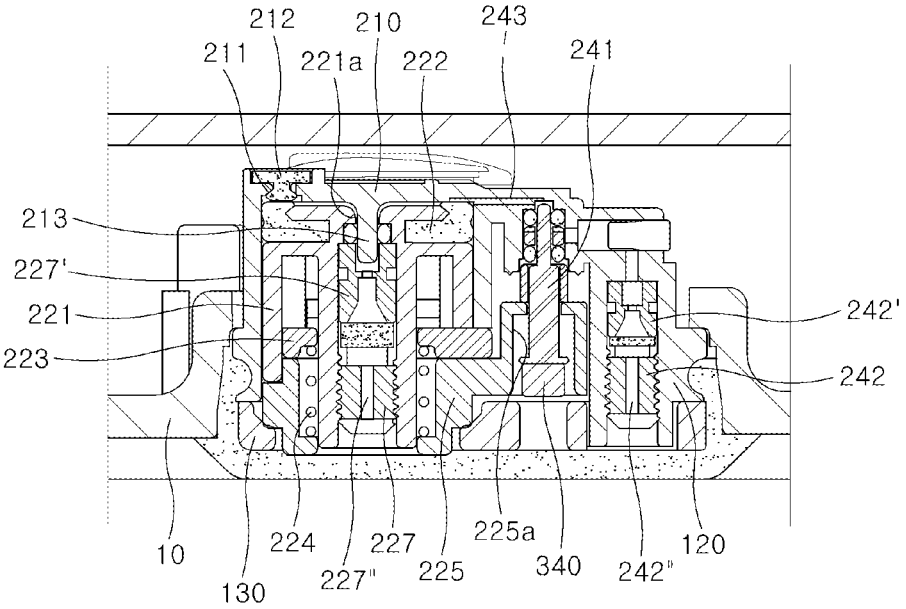

First, according to the present disclosure, when a toilet user is seated on a toilet seat 10, as shown in FIGS. 5 to 7, as the toilet seat 10 moves downward by the weight load of the toilet user, the detection switch 100 of the cover 120 compresses the seat spring 140 positioned between the cover 120 and the detection plate 130.

In addition, with the downward movement of the toilet seat 10, the lever guide 440 of the tension load part 400 presses the other end of the tension load lever 430 having one end thereof mounted in the guide groove 430*a*, and at the same time, the tension load lever 430 rotates around the guide groove 430*a* and presses the other side of the tension load spring 420 mounted on the tension load shaft 410, so that the tension load spring 420 is caught by the guide protrusion 530 formed on the flushing opening/closing part 500 and the locking protrusion 451*a* of the tension load retention member 450, whereby the tension load force of the tension load spring 420 may be held.

In this case, since one side of the tension load spring 420 is in close contact with the guide rib 210, the other side of the tension load spring 420 is rotated inward to press the locking protrusion 451*a* of the tension load retention member 450 and the guide protrusion 530 of the flushing opening/closing part 500. In addition, since the locking protrusion 451*a* and the guide protrusion 530 are formed to be inclined, the tension load retention body 451 is descended by a predetermined distance while compressing the tension load spring 420 with the compression force of the tension load spring 420, and then when the tension load spring 420 passes the locking protrusion 451*a*, the tension load retention member 450 is restored by the restoring force of the control spring 452, so that the tension load spring 420 maintains a state of being caught on the locking protrusion 451*a* and the guide protrusion 530, whereby the tension load force of the tension load spring 420 may be held.

In addition, as shown in FIGS. 8 to 11, until a time in which the tension load release control protrusion 262 is positioned at a lower part of the tension load retention control protrusion 451*b* of a tension load retention member 450 while the tension load release body 261 rotates outward around a body coupling hole due to the restoring force of the restoration elastic piece 264 in close contact with the elastic support piece 264', and in which the pressurization release piece 226 presses the tension load release guide member 260 so that the tension load release control protrusion 262 is separated from the lower part of the tension load release control protrusion 451*b*, a tension load release guide member 260 holds the tension load force so that the tension load spring 420 is not restored even when the toilet seat 10 moves upward, wherein, in the tension load release guide member 260, a pressing force of the pressurization release piece 226 is released while the pressurization release piece 226 formed in the flushing adjustment part 220 is moved upward due to ascending of the feces and urine toilet paper time control and flushing adjustment part 200.

In addition, at the same time as the feces and urine toilet paper time control and flushing adjustment part 200 ascends in accordance with the downward movement of the toilet seat 10, the flushing adjustment part 220 of the feces and urine toilet paper time control and flushing adjustment part 200 moves to an inner upper end of the guide rib 210 in conjunction with the descending motion of the toilet seat 10. In addition, at the same time as the air inside the guide rib 210 is discharged to the outside of the guide rib 210 through the inflow check valve 212 while passing through the discharge through-hole 211, a feces toilet paper time and flushing distinction protrusion 213 formed on the guide rib 210 closes the through-hole 221*a* of the air inflow adjustment member 221.

Here, the inflow check valve 212 is opened when the weight load is applied to the toilet seat 10 so as to discharge the air inside the guide rib 210 to the outside, and is closed when the weight load of the toilet user is released so as to block the inflow of the air into the interior of the guide rib 210.

When the air inflow adjustment member 221 moves to the upper part of the guide rib 210, the separation prevention member 225 compresses the restoration spring 224 in close contact with the flush washer 223. Since the flush washer 223 is caught on the guide rib 210, it is possible to maintain the compression force of the restoration spring 224 according to the movement of the separation prevention member 225.

In addition, due to the pressurizing of the guide spring 330' compressed in conjunction with the descending motion of the toilet seat 10, the feces and urine toilet paper time determination member 340 of the feces and urine toilet paper time determination part 300 presses the urine toilet paper time distinction pin 241 upward while moving to the inner upper end of the distinction guide rib 310, and the air inside the distinction guide rib 310 is not discharged through the inflow through-hole 311 closed by the feces and urine distinction discharge check valve 320, but is discharged through the feces and urine distinction discharge amount adjustment bolt 350 in which the guide through-hole 330*a* and the feces and urine distinction discharge amount adjustment hole 350" are formed.

The feces and urine distinction discharge check valve 320 closes the inflow through-hole 311 to block the inflow of air into the distinction guide rib 310 when the weight load of a toilet user is applied, and opens the inflow through-hole 311 to discharge the air inside the distinction guide rib 310 to the outside when the weight load of the toilet user is released.

While being fastened to the guide through-hole 330*a* of the guide rod 330, the feces and urine distinction discharge amount adjustment bolt 350 not only compresses an adjustment filter 350', but also adjusts the amount of air moving through the adjustment filter 350' according to the compression force of the adjustment filter 350'.

In addition, as the air inside the distinction guide protrusion 310 is discharged to the feces and urine distinction discharge amount adjustment bolt 350, the feces and urine toilet paper time determination member 340 formed on one side of the guide rod 330 presses the urine toilet paper time distinction pin 241 mounted in the distinction pin control groove 225*a* upward, and when the urine toilet paper time distinction pin 241 is unable to close a urine toilet paper time adjustment hole 243, it is determined as urination.

When it is not possible to close the urine toilet paper time adjustment hole 243 as described above, the air is suctioned into the always open feces toilet paper time adjustment hole 232 and urine toilet paper time adjustment hole 243 at the same time, so the guide rod 330 moves quickly, whereby the urination toilet paper time is applied. When a flushing section is applied, the air is simultaneously suctioned into the feces toilet paper time adjustment hole 231", the feces flushing adjustment hole 227", and the urine toilet paper time adjustment hole 242", which are always open, so the guide rod 330 moves quickly, whereby the urination toilet paper time is applied.

In addition, when the feces and urine toilet paper time determination member 340 closes the urine toilet paper time adjustment hole 243 by pressing the urine toilet paper time distinction pin 241 mounted on the distinction pin control groove 225*a* upwards, it is determined as defecation.

When the urine toilet paper time adjustment hole 243 is closed as described above, the air is not suctioned into the urine toilet paper time adjustment hole 243, but is suctioned only into the feces toilet paper time adjustment hole 232, so the guide rod 330 moves relatively slowly.

Figure 12:
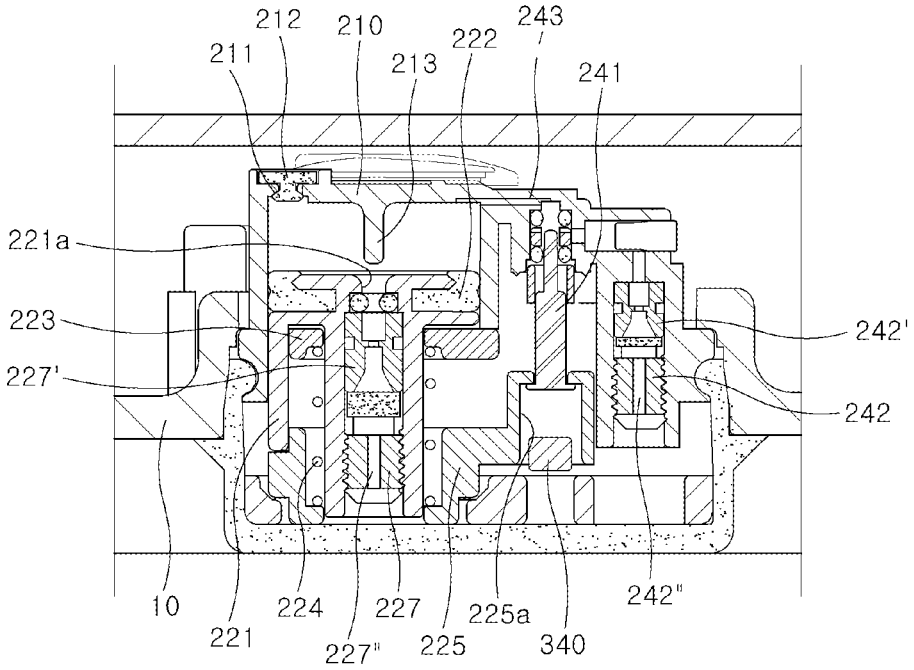
FIGS. 12 to 13 are views illustrating operation states in which defecation and urination of the toilet user are distinguished by a feces and urine toilet paper time determination part of the present disclosure and feces toilet paper time and flushing are adjusted by a feces and urine toilet paper time control and flushing adjustment part.
Figure 13:
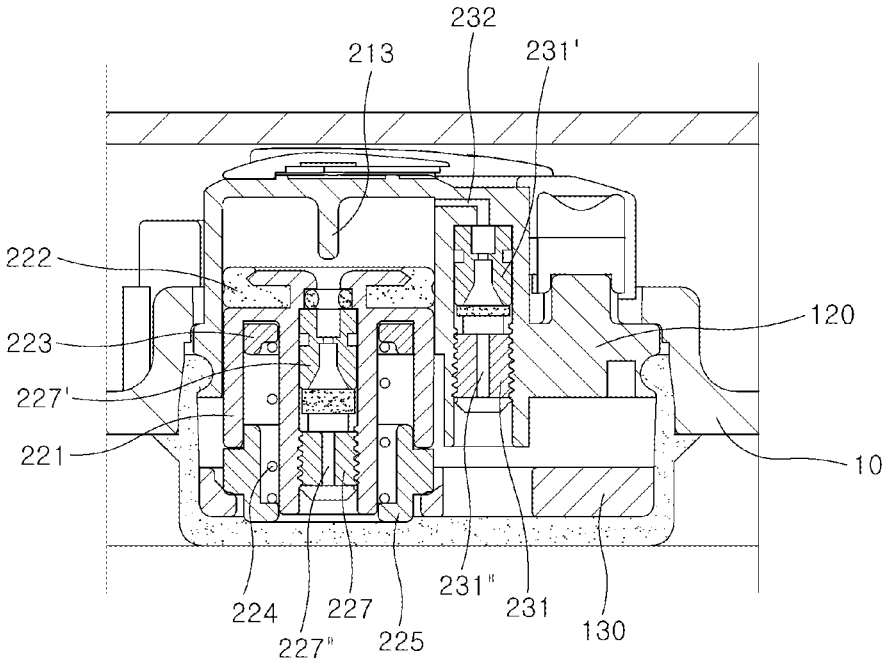
Figure 14:
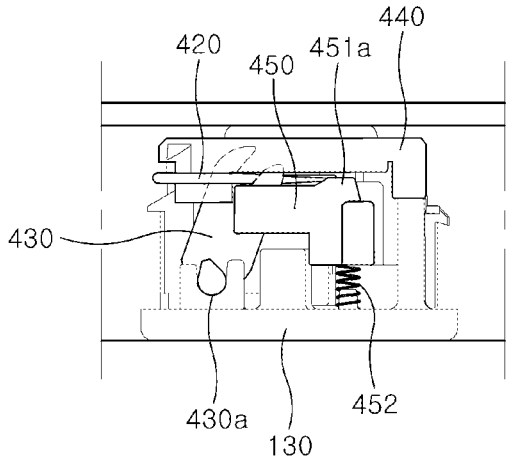
FIGS. 14 to 17 are views illustrating operation states in which excreta is flushed as the toilet user leaves the toilet seat to which the present disclosure is applied.
Figure 15:
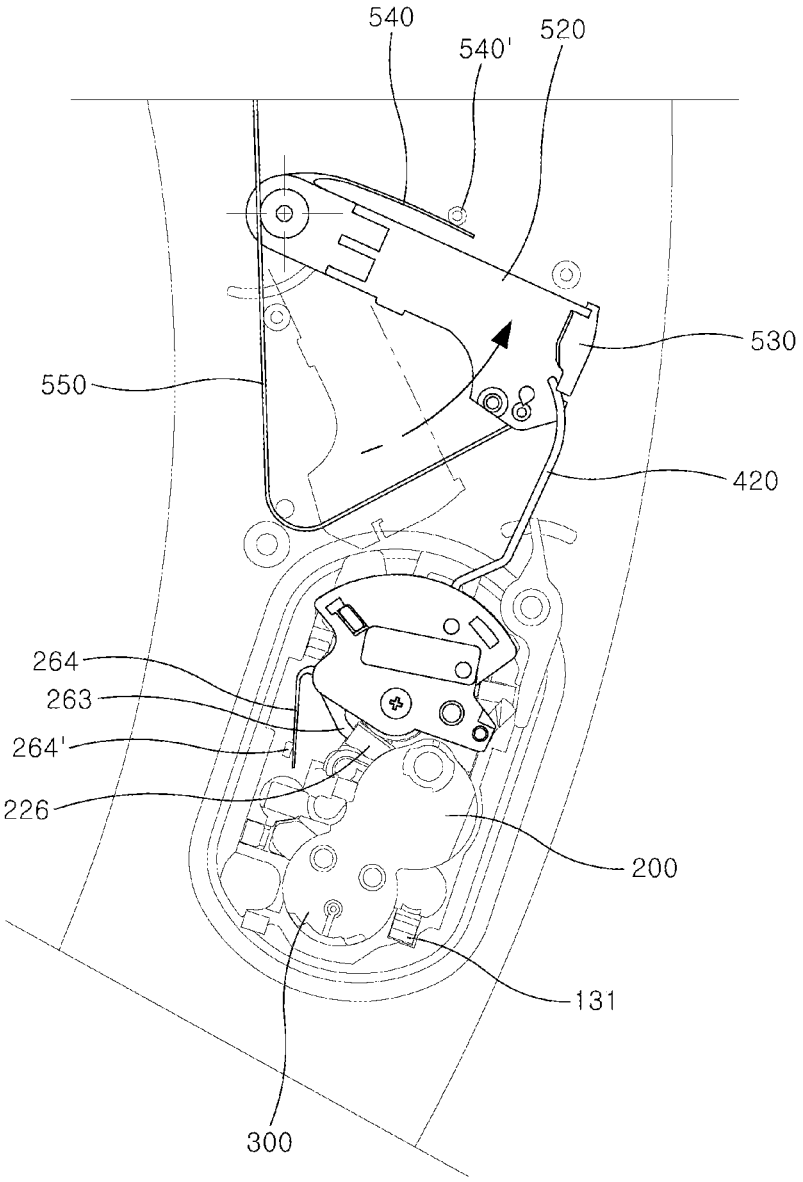
Figure 16:
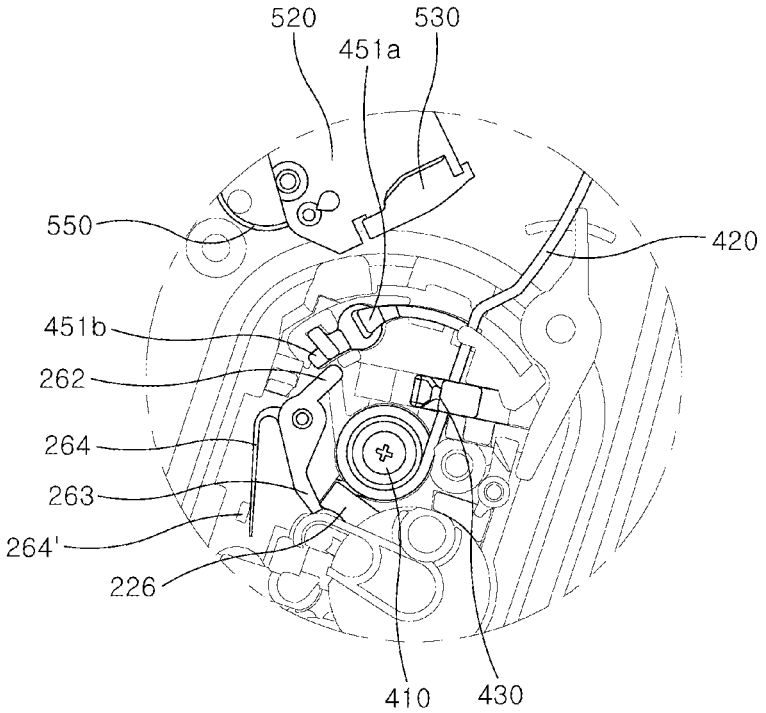
Figure 17:
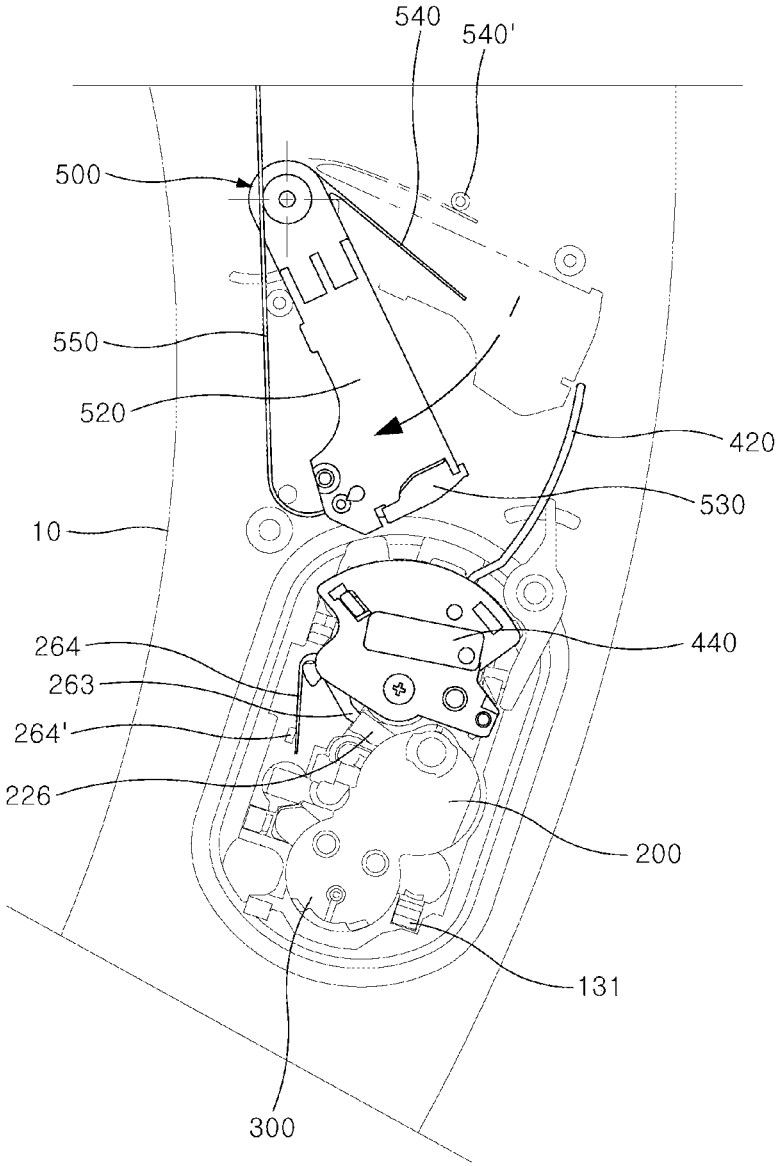

In addition, when a toilet user seated on the toilet seat 10 leaves after excretion, as shown in FIGS. 12 to 13, the toilet seat 10 ascends with the restoring force of the seat spring 140.

At this time, the air inflow adjustment member 221 of the feces and urine toilet paper time control and flushing adjustment part 200 moves to the lower end of the guide rib 210 with the restoring force of the restoration spring 224, and since the inflow check valve 212 closes the discharge through-hole 211 formed in the guide rib 210, the air is introduced into the guide rib 210 only through a feces flushing adjustment bolt 227, the feces toilet paper time adjustment part 230, and a urine toilet paper time adjustment part 240.

In other word, in a case where the excretion of the toilet user is determined as urination, the air is introduced into the guide rib 210 through the feces flushing adjustment bolt 227 mounted on the air inflow adjustment member 221, the air is introduced into the guide rib 210 through the feces toilet paper time adjustment bolt 231 and the feces toilet paper time adjustment hole 232, and at the same time, the air is introduced into the guide rib 210 through a urine toilet paper time adjustment bolt 242 and the urine toilet paper time adjustment hole 243.

In addition, in a case where the excretion of the toilet user is determined as defecation, the air is not introduced through the urine toilet paper time adjustment bolt 242, but the air is introduced into the guide rib 210 through the feces flushing adjustment bolt 227 mounted on the air inflow adjustment member 221, and at the same time, the air is introduced into the guide rib 210 through the feces toilet paper time adjustment bolt 231 and the feces toilet paper time adjustment hole 232.

Here, in the air introduced into the feces flushing adjustment bolt 227, an amount of air moved by passing through the adjustment filter 227' may be adjusted according to the compression force by which the feces flushing adjustment bolt 227 is fastened, and according to the compression force by which the feces toilet paper time adjustment bolt 231 and the urine toilet paper time adjustment bolt 242 are fastened, the amount of air that moves may also be adjusted.

In addition, as shown in FIGS. 14 to 17, when the air inflow adjustment member 221 moves to the lower end of the guide rib 210, an inclined surface of a pressurization release surface 226 formed on the feces and urine toilet paper time control and flushing adjustment part 200 presses a tension load release guide protrusion 263 of a tension load release guide member 260, and the tension load release guide member 260 compresses a restoration elastic piece 264 in close contact with an elastic support piece 264' while rotating inward around the body coupling hole to generate a restoring force, and at the same time, the tension load release control protrusion 262 is separated from the tension load retention control protrusion 451*b* of the tension load retention member 450.

While the tension load retention member 450 of which the locking is released by rotating of the tension load release guide member 260 due to the pressure of the pressure release piece 226 compresses a control spring 452 by the pressing of the lever guide 440 moving downward, when the control power of the tension load spring 420 is lost as the tension load retention body 451 moves downward, the tension load spring 420 is restored by the compressed tension load force.

In this case, since the end of the tension load spring 420 is caught on the guide protrusion 530, the wire guide 520 rotates outwardly around the rotation guide shaft 510, and the elastic support piece 540' buffers the rotational force of the wire guide 520, pulls the flushing wire 550 connecting the inside of the toilet seat 10 to the siphon cover 20 and the wire guide 520, and at the same time, rotates the siphon cover 20 upward to open the water drain hole of the water tank, so that the flushing water of the water tank is discharged to the toilet body through the opened water drain hole, thereby flushing the toilet.

In addition, when the tension load spring 420 is separated from the guide protrusion 530, a locking state of the wire guide 520 is released, and when the locking is released as described above, the siphon cover 20 descends and closes the water drain hole of the water tank.

At this time, while pulling the flushing wire 550 due to the downward movement of the siphon cover 20, the wire guide 520 is restored by rotating around the rotation guide shaft 510 and waits for the next operation.

As described above, although the present disclosure has been described by a limited exemplary embodiment and drawings, the terms or words used in the disclosure and claims should not be interpreted to be limited to a conventional or dictionary meaning, and should be interpreted as meanings and concepts corresponding to the technical spirit of the present disclosure. Therefore, the exemplary embodiment described in the present disclosure and the configurations shown in the drawings are only an exemplary embodiment of the present disclosure, and do not represent all the technical spirit of the present disclosure, and accordingly, it should be appreciated that various equivalents and modifications are possible, without departing from the scope of the accompanying claims of the present disclosure.

The invention claimed is:

1. A powerless automatic flushing device for automatically controlling toilet paper disposal time according to feces and urine, the powerless automatic flushing device comprising:

a detection switch (100) configured to guide descending motion of a toilet seat (10) under a weight load of a toilet user, and allow the toilet seat (10) to ascend when the pressurizing weight load is released as the toilet user leaves the toilet seat (10);

a feces and urine toilet paper time control and flushing adjustment part (200) configured to discharge air inside a guide rib (210) while a flushing adjustment part (220) ascends in conjunction with the descending motion of the toilet seat (10), control time to dispose of toilet paper with the feces while suctioning air from outside through a feces toilet paper time adjustment hole (231") with a restoring force of a restoration spring (224) when the toilet user leaves the toilet seat after defecation, and control time to dispose of toilet paper with the urine while rapidly suctioning the air from the outside through the feces toilet paper time adjustment hole (231") and a urine toilet paper time adjustment hole (242") when the toilet user leaves the toilet seat after urination;

a feces and urine toilet paper time determination part (300) configured to adjust an amount of air discharged from inside a distinction guide rib (310) to the outside while a guide rod (330) moves to an inside of the distinction guide rib (310) in conjunction with the descending motion of the toilet seat (10), determine excretion as the urination when a feces and urine toilet paper time determination member (340) fails to press a urine toilet paper time distinction pin (241), and a urine toilet paper time adjustment hole (243) is opened, and determine the excretion as the defecation when the feces and urine toilet paper time determination member (340) presses the urine toilet paper time distinction pin (241) and closes the urine toilet paper time adjustment hole (243);

a tension load part (400) configured to retain a tension load force capable of pulling a flushing wire (550) of a flushing opening/closing part (500) while a tension load spring (420) is compressed by rotation of a tension load lever (430) in conjunction with the descending motion of the toilet seat (10), and rotate a wire guide (520) with the restoring force of the tension load spring (430) to pull the flushing wire (550) as the toilet seat (10) ascends when the pressurizing weight load of the toilet user is released; and the flushing opening/closing part (500) configured to open a water drain hole while a siphon cover (20) rotates by the flushing wire (550), which is rotated and pulled by the wire guide (520) by the tension load force of the tension load spring (430), flush excreta with flushing water supplied to a toilet body through the water drain hole, and close the water drain hole while restoring the wire guide (520) by descending of the siphon cover (20) when the tension load force of the tension load spring (430) is released.

2. A powerless automatic flushing device for automatically controlling toilet paper disposal time according to feces and urine, the powerless automatic flushing device comprising:

a detection switch (100) configured to guide descending motion of a toilet seat (10) under a weight load of a toilet user, and allow the toilet seat (10) to ascend when the pressurizing weight load is released as the toilet user leaves the toilet seat (10);

a feces and urine toilet paper time control and flushing adjustment part (200) configured to discharge air inside a guide rib (210) while a flushing adjustment part (220) and a urine toilet paper time adjustment part (240) ascend in conjunction with the descending motion of the toilet seat (10), control time to dispose of toilet paper with the feces and time to flush the feces while suctioning air from outside through a feces toilet paper time adjustment hole (231") and the feces flushing adjustment hole (227") with a restoring force of a restoration spring (224) when the toilet user leaves the toilet seat after defecation, and control the flushing of urine and time to dispose of toilet paper with the urine while rapidly suctioning the air from the outside through the feces toilet paper time adjustment hole (231"), the feces flushing adjustment hole (227"), and a urine toilet paper time adjustment hole (242") when the toilet user leaves the toilet seat after urination;

a feces and urine toilet paper time determination part (300) configured to adjust an amount of air discharged from inside a distinction guide rib (310) to the outside while a guide rod (330) moves to an inside of the distinction guide rib (310) in conjunction with the descending motion of the toilet seat (10), determine excretion as the urination when a feces and urine toilet paper time determination member (340) fails to press a urine toilet paper time distinction pin (241), and a urine toilet paper time adjustment hole (243) is opened, and determine the excretion as the defecation when the feces and urine toilet paper time determination member (340) presses the urine toilet paper time distinction pin (241) and closes the urine toilet paper time adjustment hole (243);

a tension load part (400) configured to retain a tension load force capable of pulling a flushing wire (550) of a flushing opening/closing part (500) while a tension load spring (420) is compressed by rotation of a tension load lever (430) in conjunction with the descending motion of the toilet seat (10), and rotate a wire guide (520) with the restoring force of the tension load spring (430) to pull the flushing wire (550) as the toilet seat (10) ascends when the pressurizing weight load of the toilet user is released; and the flushing opening/closing part (500) configured to open a water drain hole while a siphon cover (20) rotates by the flushing wire (550), which is rotated and pulled by the wire guide (520) by the tension load force of the tension load spring (430), flush excreta with flushing water supplied to a toilet body through the water drain hole, and close the water drain hole while restoring the wire guide (520) by descending of the siphon cover (20) when the tension load force of the tension load spring (430) is released.

3. The powerless automatic flushing device of claim 1, wherein the detection switch (100) comprises:

an installation hole (110) formed on the toilet seat;

a cover (120) configured to be mounted on the installation hole (110) and have a hook coupling hole (121) penetrating therein, to which a hook (131) protruding from a detection plate (130) is allowed to be coupled;

the detection plate (130) mounted to the toilet body as the hook (131) is coupled to the hook coupling hole (121) penetrating the cover (120); and a seat spring (140) mounted between the cover (120) and the detection plate (130).

4. The powerless automatic flushing device of claim 1, wherein the urine rest time control and flushing adjustment part (200) comprises:

the guide rib (210) configured to protrude from a cover (120) of the detection switch (100), have a discharge through-hole (211) penetrating therein to be opened and closed by an inflow check valve (212), and have a feces toilet paper time and flushing distinction protrusion (213) protruding from an inner bottom surface thereof;

the flushing adjustment part (220) configured to be embedded in the guide rib (210), discharge the air inside the guide rib (210) to the inflow check valve (212) opened in conjunction with the descending motion of the toilet seat, and adjust an amount of air introduced into the guide rib (210) while closing the inflow check valve (212) in conjunction with the ascending motion of the toilet seat;

a feces toilet paper time adjustment part (230) configured to be mounted in the guide rib (210) on one side of the flushing adjustment part (220) and adjust the amount of the air introduced into the guide rib (210);

the urine toilet paper time adjustment part (240) configured to ascend and descend by the feces and urine toilet paper time determination member (340) of the feces and urine toilet paper time determination part (300) to open and close the urine toilet paper time adjustment hole (243) when the toilet user leaves the toilet seat, and adjust the amount of the air introduced into the guide rib (210); and a tension load release guide member (260) configured to be pressed by a pressurization release piece (226) while the flushing adjustment part (220) ascends into the guide rib (210) and release a supporting force of a tension load retention member (450) of the tension load part (400).

5. The powerless automatic flushing device of claim 4, wherein the flushing adjustment part (220) comprises:

an air inflow adjustment member (221) configured to ascend and descend inside of the guide rib (210) and have a through-hole (221*a*) penetrating therein, to which the feces toilet paper time and flushing determination protrusion (213) is allowed to be coupled;

a seating cover (222) seated on an upper surface of the air inflow adjustment member (221);

a flush washer (223) mounted on the air inflow adjustment member (221) to support the restoration spring (224);

the restoration spring (224) mounted on the air inflow adjustment member (221) so as to be in close contact with the flush washer (223);

a separation prevention member (225) configured to be mounted on a lower end of the air inflow adjustment member (221) to compress the restoration spring (224) in conjunction with the descending motion of the toilet seat (10) while preventing the restoration spring (224) from being separated and have a distinction pin control groove (225*a*) formed on an outer peripheral surface thereof;

the pressurization release piece (226) formed on one side of the separation prevention member (225); and a feces flushing adjustment bolt (227) configured to have an adjustment filter (227') mounted on a lower inner side of the air inflow adjustment member (221) to adjust an amount of air introduced into the through-hole (221*a*), and have an inside thereof through which a feces flushing adjustment hole (227") communicates.

6. The powerless automatic flushing device of claim 4, wherein the feces toilet paper time adjustment part (230) comprises:

a feces toilet paper time adjustment bolt (231) configured to be mounted on a lower part of the guide rib (210), have an adjustment filter (231') mounted thereon to adjust the amount of the air introduced into the guide rib (210), and have an inside thereof through which the feces toilet paper time adjustment hole (231") communicates; and a feces toilet paper time adjustment hole (232) configured to communicate the feces toilet paper time adjustment bolt (231) and the inside of the guide rib (210).

7. The powerless automatic flushing device of claim 4, wherein the urine toilet paper time adjustment part (240) comprises:

the urine toilet paper time distinction pin (241) configured to be mounted on a distinction pin control groove (225*a*) of the flushing adjustment part (220) and determine the excretion as urination when the urine toilet paper time adjustment hole (243) is not closed;

a urine toilet paper time adjustment bolt (242) configured to be mounted on a lower part of the guide rib (210) on one side of the feces toilet paper time adjustment part (230), have an adjustment filter (242') mounted thereon so as to adjust the amount of the air introduced into the guide rib (210), and have an inside thereof, through which the urine toilet paper time adjustment hole (242") communicates; and the urine toilet paper time adjustment hole (243) configured to communicate the urine toilet paper time adjustment bolt (242) and the inside of the guide rib (210).

8. The powerless automatic flushing device of claim 4, wherein the tension load release guide member (260) comprises:

a tension load release guide body (261) configured to be mounted on a body coupling hole formed in a cover (120) and rotate;

a tension load release control protrusion (262) formed on one side of the tension load release guide body (261) so as to be selectively caught on the tension load retention control protrusion (451*b*) of the tension load retention member (450);

a tension load release guide protrusion (263) formed on the other side of the tension load release guide body (261) at an obtuse angle with the tension load release control protrusion (262) so as to allow the pressurization release piece (226) to press; and a restoration elastic piece (264) configured to protrude with elasticity from the one side of the tension load release guide body (261) and be supported by an elastic support piece (264') formed on the cover (120) so as to restore the tension load release guide body (261) in which the pressurizing force of the pressurization release piece (226) is released.

9. The powerless automatic flushing device of claim 1, wherein the feces and urine toilet paper time determination part (300) comprises:

the distinction guide rib (310) configured to protrude from a cover (120) of the detection switch (100) and have an inside thereof, through which an inflow through-hole (311) penetrates;

a feces and urine distinction discharge check valve (320) configured to open and close the inflow through-hole (311) of the distinction guide rib (310);

the guide rod (330) configured to be embedded in the distinction guide rib (310) and discharge air inside the distinction guide rib (310) to a guide through-hole (330*a*) while moving by pressure of a guide spring (330') in conjunction with the descending motion of the toilet seat (10);

the feces and urine toilet paper time determination member (340) configured to protrude from one side of the guide rod (330) and press the urine toilet paper time distinction pin (241); and a feces and urine distinction discharge amount adjustment bolt (350) configured to be fastened to a lower inner side of the guide rod (330), have an adjustment filter (350') mounted thereon to adjust an amount of air discharged to the guide through-hole (330*a*), and have a feces and urine distinction discharge amount adjustment hole (350") formed therein and communicating the inside of the distinction guide rib (310).

10. The powerless automatic flushing device of claim 1, wherein the tension load part (400) comprises:

a tension load shaft (410) configured to protrude from a cover (120) of the detection switch (100);

a tension load member (420) configured to be mounted on the tension load shaft (410), be caught on a guide protrusion (530) while rotated by pressure of the tension load lever (430), and secure the tension load force capable of pulling the flushing wire (550);

the tension load lever (430) configured to be rotatably mounted in a guide groove (430*a*) formed in the detection plate (130) of the detection switch (100) and accommodate one end of the tension load spring (420) so as to press and rotate the tension load spring (420);

a lever guide (440) configured to be mounted on the cover (120) to prevent separation of the tension load lever (430) from the guide groove (430*a*); and a tension load retention member (450) configured to hold the tension load force until the tension load spring (420) is released while accommodating the tension load spring (420) in which the tension load force is generated by rotation under the pressure of the tension load lever (430).

11. The powerless automatic flushing device of claim 10, wherein the tension load retention member (450) comprises:

a tension load retention body (451) configured to have a locking protrusion (451*a*) formed inclined so that the tension load spring (420) moves and is caught, and have a tension load retention control protrusion (451*b*) formed on the other side of the locking protrusion (451*a*); and a control spring (452) configured to support the tension load retention body (451).

12. The powerless automatic flushing device of claim 1, wherein the flushing opening/closing part (500) comprises:

a rotation guide shaft (510) formed on the toilet seat (10);

the wire guide (520) rotatably mounted to the rotation guide shaft (510);

the guide protrusion (530) configured to obliquely protrude from one end of the wire guide (520) to be rotatable by the tension load spring (420);

an elastic piece (540) configured to protrude from a side end of the wire guide (520) to support the wire guide (520); and the flushing wire (550) configured to connect the wire guide (520) and the siphon cover (20) to each other and flush the water by rotation of the wire guide (520).

* * * * *